US006851412B2

(12) United States Patent
Jay

(10) Patent No.: US 6,851,412 B2
(45) Date of Patent: Feb. 8, 2005

(54) FUEL INJECTION SYSTEM FOR A PISTON ENGINE

(75) Inventor: David C. Jay, Vähäkyrö (FI)

(73) Assignee: Wartsila Finland Oy, Vaasa (FI)

( * ) Notice: Subject to any disclaimer, the term of this patent is extended or adjusted under 35 U.S.C. 154(b) by 8 days.

(21) Appl. No.: 10/411,597

(22) Filed: Apr. 7, 2003

(65) Prior Publication Data

US 2003/0230284 A1 Dec. 18, 2003

(30) Foreign Application Priority Data

Apr. 8, 2002 (FI) ..... 20020667

(51) Int. Cl.[7] ..... F02M 55/00
(52) U.S. Cl. ..... 123/456; 123/467; 123/468
(58) Field of Search ..... 123/456, 467, 123/193.5, 468, 469

(56) References Cited

U.S. PATENT DOCUMENTS 5,311,850 A 5/1994 Martin
5,687,696 A * 11/1997 Takagi et al. ..... 123/516
6,152,109 A * 11/2000 Melchior ..... 123/447
2004/0035398 A1 * 2/2004 Klugl et al. ..... 123/456

FOREIGN PATENT DOCUMENTS

| | | |
|---|---|---|
| WO | 95/17594 | 6/1995 |
| WO | 98/42978 | 10/1998 |
| WO | 01/11226 | 2/2001 |
| WO | 01/25615 | 4/2001 |

* cited by examiner

*Primary Examiner*—Thomas Moulis
(74) *Attorney, Agent, or Firm*—John Smith-Hill; Smith-Hill and Bedell

(57) ABSTRACT

A fuel injection system for a piston engine, in which the piston engine comprises an engine block with cylinders arranged thereto and at least one fuel injector nozzle arranged for each cylinder and connected to the fuel injection system and in which the fuel injection system comprises at least one fuel pressure accumulator. The fuel injection system comprises a dedicated fuel pressure accumulator for each cylinder.

23 Claims, 3 Drawing Sheets

FUEL INJECTION SYSTEM FOR A PISTON ENGINE

BACKGROUND OF THE INVENTION

The invention relates to a fuel injection system for a piston engine.

So-called common rail systems have frequently been applied in fuel injection systems for piston engines. In a conventional common rail system, fuel is injected into a common pressure accumulator under high pressure, wherefrom the fuel is dosed into each cylinder of the engine by controlling the action of the injector nozzle.

The common pressure accumulator must be designed to be very strong so as to withstand the high pressures which are typically of the order of >100 MPa. Similar to pressure vessels, the pressure accumulators are typically cylindrical in design. This kind of design leads to great wall thickness and thereby also, for example, the space requirement is large compared to the volume of the pressure accumulator.

Common prior art is represented by a common rail solution disclosed in the applicant's previous U.S. Pat. No. 6,240,901. In this solution, fuel is fed from the fuel tank to the pressure accumulator by means of a high pressure pump, subsequent to which the fuel is injected into cylinders of the engine by means of injectors. The fuel pressure accumulator comprises at least two separate pressure accumulator units, each of which is connected to at least two injectors and provided with an individual high pressure pump. In order to equalize pressure, the pressure chambers of the pressure accumulator units are continuously connected to each other and one of the pressure accumulator units of the system is provided with a valve, by means of which the pressure chamber of this pressure accumulator unit and the pressure chambers connected thereto can be connected to the fuel tank. This kind of solution, however, requires a relatively large space around the engine. In this publication, the pressure accumulators are described as cylindrical chambers with thick walls, which, as described in the above, leads to great wall thicknesses and, consequently, the space requirements are also relatively great.

The present invention may be used to provide a fuel injection system for a piston engine minimizing the problems associated with prior art. The present invention may specifically be used to provide a fuel injection system for a piston engine minimizing the space requirements adjacent the engine.

SUMMARY OF THE INVENTION

In accordance with the present invention there is provided a piston engine comprising an engine block having a plurality of cylinders therein, and a fuel injection system for supplying fuel to the cylinders, the fuel injection system comprising at least one fuel injector nozzle for each cylinder and a dedicated fuel pressure accumulator for each cylinder.

Preferably the fuel pressure accumulator for each cylinder is arranged at least partially within the cylinder head of the engine. In this manner the cylinder head structure that surrounds or envelopes the accumulator may serve e.g. as a supporting casing for the accumulator.

The pressure accumulators are preferably in fluid communication with each other. The connection may be realized by means of a tube system external to the cylinder head.

In an embodiment of the invention, the total volume of each pressure accumulator is at least 30 times greater than the volume of fuel injected by one injector nozzle during one combustion stroke of the engine. This allows a proper pressure level to be maintained in the system also during injections.

In a preferred embodiment of the invention, each cylinder has a separate cylinder head and the pressure accumulator extends from outside the cylinder head to the injector nozzle. Thus the accumulator is substantially enveloped or surrounded by the cylinder head.

Preferably the pressure accumulator defines at least two separate chambers, in open fluid communication with each other, and bounded by an at least partially common intermediate wall. This allows control of the stresses in the pressure accumulator to be improved and the space requirements to be reduced by the smaller wall thicknesses necessary.

In an embodiment of the invention the pressure accumulator defines a main chamber and at least one auxiliary chamber in open fluid communication with each other by at least two different routes. The main chamber of the pressure accumulator is connected to the fuel injector nozzle and the auxiliary chamber is connected to the fuel channel or conduit that feeds fuel to the pressure accumulator.

The pressure accumulator preferably comprises a longitudinally elongated body part and first and second end parts. The chambers of the pressure accumulator extend longitudinally of the body part and each end part defines at least one flow passage connected to at least one of the chambers.

The body part of the pressure accumulator is essentially round in cross-section and the chambers are essentially round spaces, such as bores, parallel with the longitudinal axis of the body part. The chambers are arranged essentially symmetrically with respect to the central axis of the body part when viewed in the cross section of the body part.

BRIEF DESCRIPTION OF THE DRAWINGS

In the following the invention is described by way of example and with reference to the appended drawings, of which

DETAILED DESCRIPTION

Figure 1:
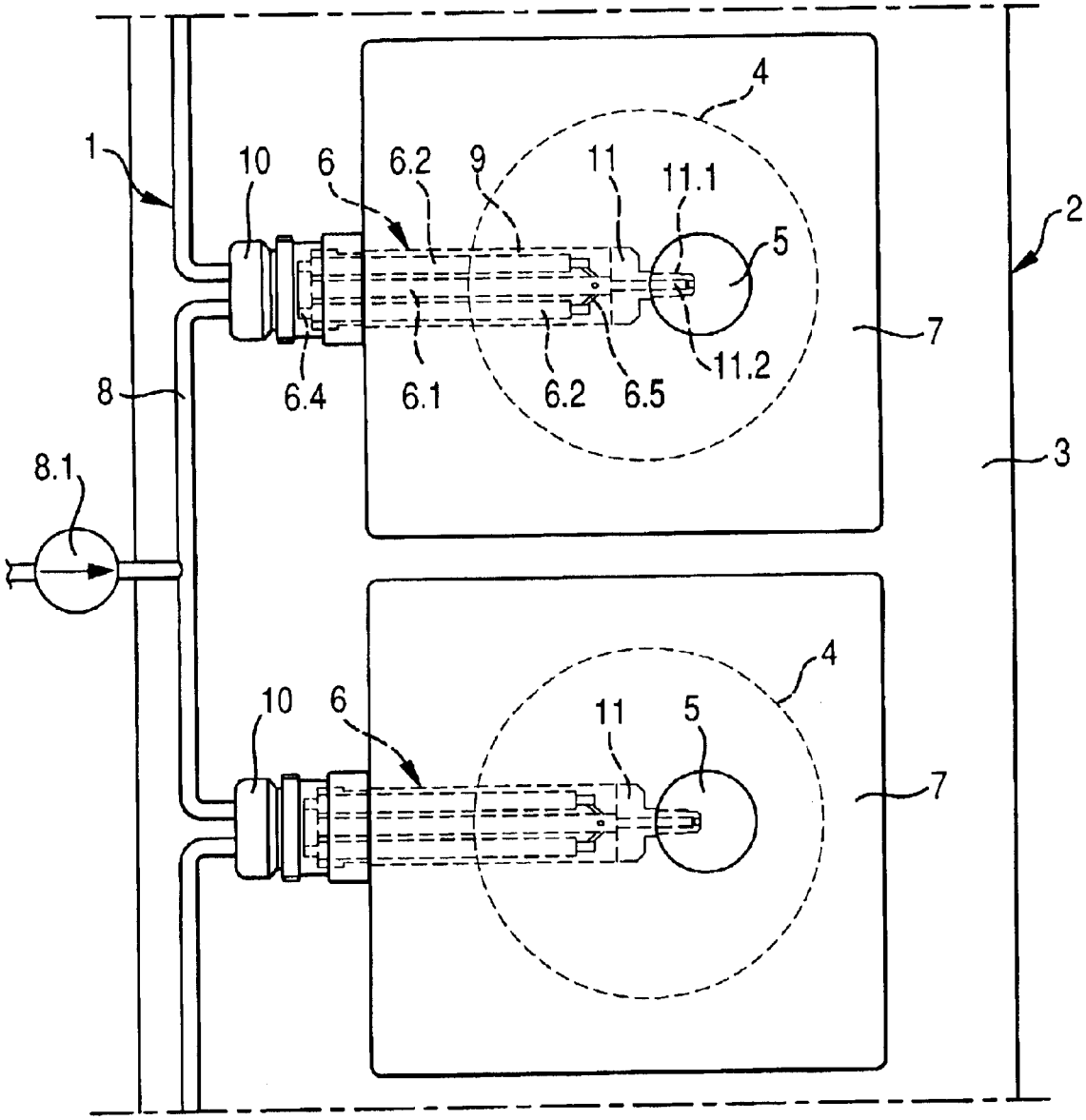
FIG. 1 is a schematical representation of a fuel injection system embodying the invention.

FIG. 1 schematically shows a part of a piston engine 2 with a fuel injection system 1 connected thereto. The basic design of the piston engine is known as such, as is the fuel injection system. The piston engine comprises a number of cylinders 4 arranged in the engine block 3, each of the cylinders having a separate cylinder head 7. Each cylinder is provided with at least one fuel injector nozzle 5. The fuel injection system comprises at least one fuel pressure accumulator 6. Each cylinder 4 is provided with its own individual, separate, i.e. dedicated, fuel pressure accumulator 6. The fuel pressure accumulator 6 of each cylinder 4 is at least partially enveloped or surrounded by the engine cylinder head 7 and extends to the injector nozzle 5. Consequently, the system is very compact.

The pressure accumulator 6 comprises a longitudinally elongated main body part 9, of preferably cylindrical form, a first end part 10 and a second end part 11. A tube system 8 external to the cylinder head serves as a fuel channel for supplying fuel to the pressure accumulators and is connected with the pressure accumulator 6 by way of the first end part 10. The tube system 8 is connected to a high pressure fuel pump 8.1. The pressure accumulators 6 are in flow connection with each other as well as with the rest of the fuel injection system 1 mainly by means of the tube system 8.

Because the fuel pressure accumulators 6 are at least partially accommodated within the respective cylinder heads 7, the fuel pressure accumulators 6 take less space and, on the other hand, the structure of the cylinder head can be used as a cover for the pressure accumulators. Thus, for example, fuel that leaks from a pressure accumulator can initially be confined to within the region of the pressure accumulator in the cylinder head 7, whereby it can also be faster noticed. Further, heat is convected from the cylinder head to the pressure chamber, heating the fuel. This solution also brings the pressure chamber closer to the fuel injector nozzle 5, whereby flow pressure losses between the pressure accumulator 6 and the injector nozzle 5 are reduced. Preferably the pressure accumulator 6 is almost totally enclosed within the cylinder head and only parts necessary for connecting to the fuel channel are left outside the cylinder head.

Figure 2:
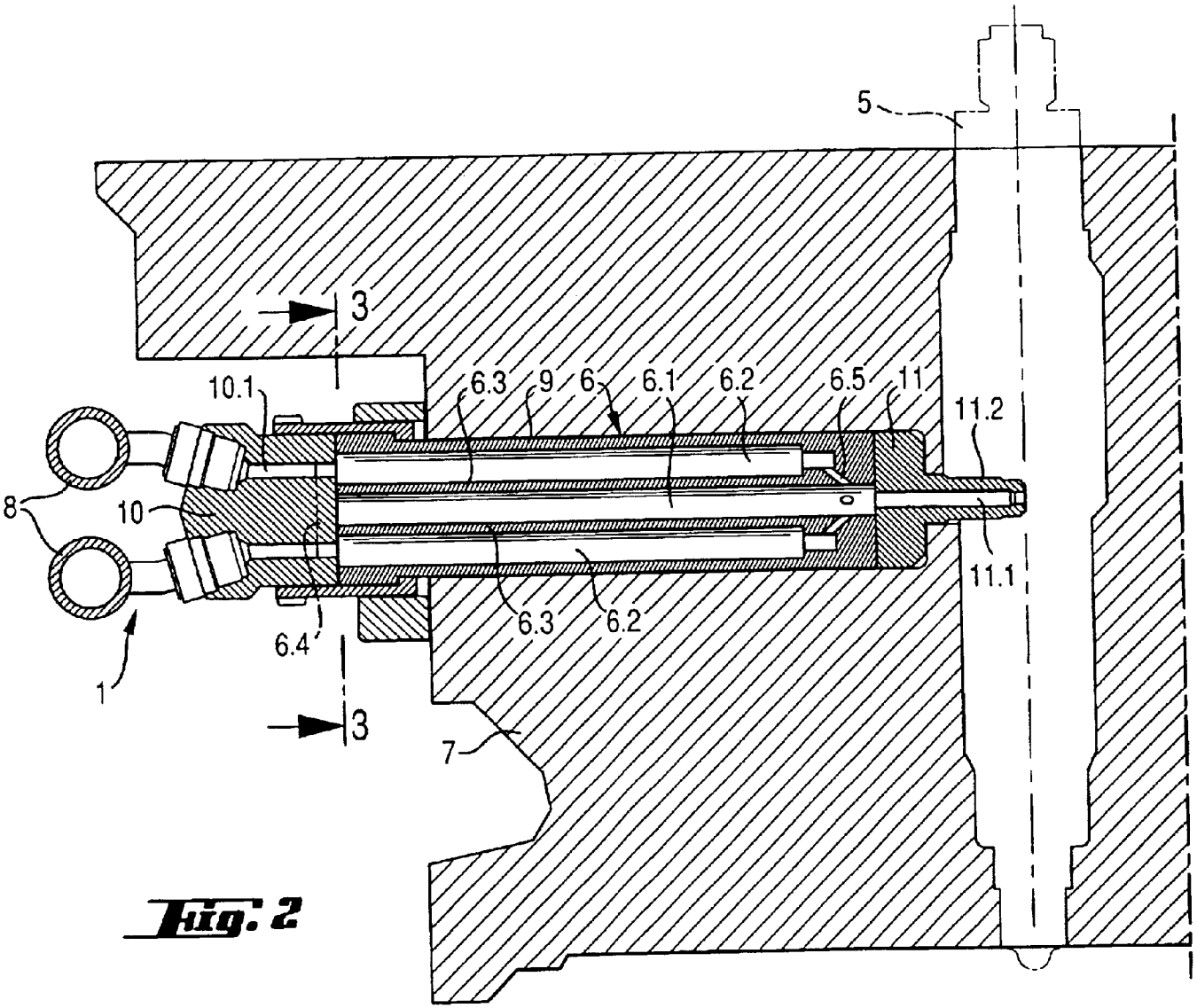
FIG. 2 is a detail of a fuel injection system of FIG. 1.
Figure 3:
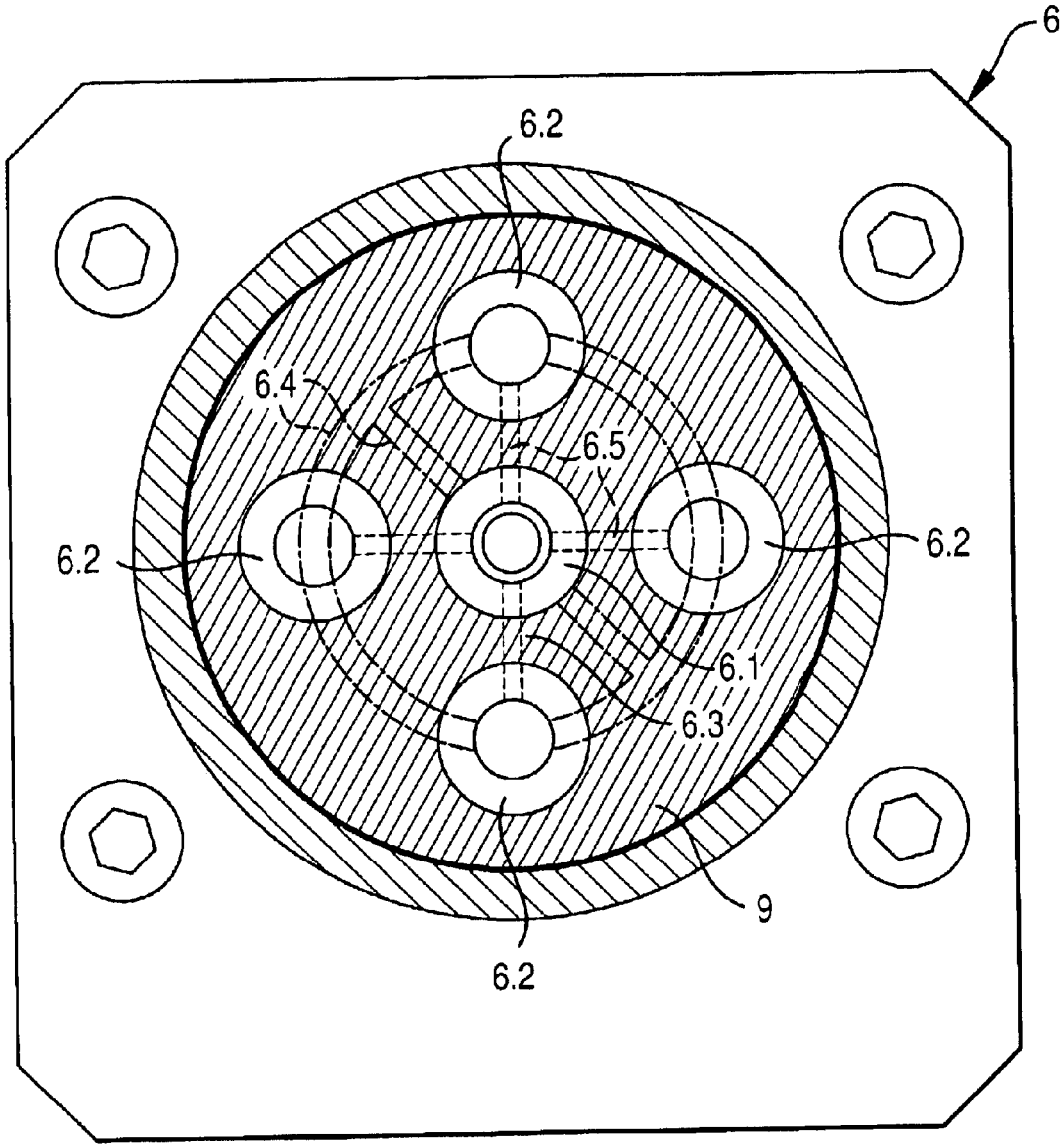
FIG. 3 is section 3—3 of FIG. 2.

FIG. 2 shows an advantageous embodiment of a pressure accumulator 6 arranged in the cylinder head 7, in connection with the fuel injector nozzle 5, which may be of conventional form. The main body part 9 of the accumulator 6 is generally cylindrical in form and defines at least two separate chambers 6.1, 6.2. In this embodiment there is one main chamber 6.1 on the central axis of the pressure accumulator and there are four auxiliary chambers 6.2 arranged symmetrically in relation to the central axis, as can be seen in FIG. 3.

The tube system 8 is connected directly to the auxiliary chambers 6.2 by longitudinal bores or passages 10.1 in the first end part 10. The auxiliary chambers 6.2 are interconnected by passages 6.4 formed by grooves or the like in the first end part 10. The passages 6.4 at the outer end of the main chamber also connect the auxiliary chambers 6.2 to the main chamber 6.1. In addition, the auxiliary chambers and the main chamber are interconnected at the inner end of the main chamber by passages 6.5 formed by bores in the body part 9.

The second end part 11 comprises a tubular extension 11.2 provided with a flow channel or passage 11.1 that extends from the main chamber 6.1 of the pressure accumulator to a fuel chamber of the fuel injector nozzle 5 so that together the second end part 11 and the fuel injector nozzle 5 form a short and sealed flow connection passage for the fuel. The second end part 11 of the pressure accumulator 6 thus provides a substantially direct connection, i.e. without intermediate passages, between the fuel pressure accumulator 6 and the injector nozzle.

As described above, interconnections between the main chamber 6.1 and the auxiliary chambers 6.2 are provided by the grooves 6.4 in the first end part 10 and the bores 6.5 in the main body part 9. A corresponding functionality may also be provided by means of a solution wherein the body part defines only the longitudinal bores for the chambers 6.1, 6.2 and the passages for interconnecting them are provided in the end parts 10, 11 by means of grooves, bores or the like.

By providing multiple chambers in the body part 9, it is possible to make the outer wall of the main body part with a thinner wall thickness than otherwise, as some of the stresses caused by the pressure can be compensated within each other by means of the pressure chamber divided in parts so that the total pressure exerted on the outer surface is reduced. Thus, the main point is to produce a number of partial volumes, which are then suitably connected to each other in the pressure accumulator 6. The total volume formed by the partial volumes is at least 30 times greater than the volume of fuel injected by one injector nozzle 5 during one combustion stroke of the engine.

The chambers 6.1, 6.2 are arranged inside the body part 9 and extend from one end thereof towards the other end. Only the main chamber 6.1 extends completely through the body part from end to end thereof and other chambers 6.2 are connected to the chamber 6.1 via the bores 6.5 or the like. Fuel is fed to the pressure accumulator 6 via the end part 10 and is further fed to the fuel injector nozzles 5 via the flow channel 11.1 in the second end part 11.

FIG. 3 shows in greater detail the arrangement of the chambers in the cross-section of the body part 9 of the pressure accumulator 6. The chambers 6.1, 6.2 are preferably arranged so that they are essentially symmetrically located in relation to the central axis of the body part 9. In this figure one of the chambers 6.1, which in this embodiment extends through the body part 9, is on the central axis of the body part and other chambers 6.2 are arranged symmetrically relative to the cross-section of the body part 9. Two adjacent chambers are always separated by a common intermediate wall 6.3 and as the two adjacent chambers are at essentially the same pressure, the pressure stresses compensate each other to a considerable degree.

The invention is not limited to the embodiments described here, but a number of modifications thereof can be conceived of within the scope of the appended claims. For example, the invention is not restricted to there being one fuel injector nozzle for each cylinder since each cylinder may be provided with multiple fuel injector nozzles. In the latter event, there may be a dedicated fuel pressure accumulator for each fuel injector nozzle.

What is claimed is:

1. A piston engine comprising:

an engine block having a plurality of cylinders therein, and a fuel injection system for supplying fuel to the cylinders, the fuel injection system comprising at least one fuel injector nozzle for each cylinder and a dedicated fuel pressure accumulator for each cylinder, wherein the engine includes a cylinder head and the fuel pressure accumulators are located at least partially within the cylinder head.

2. A piston engine comprising:

an engine block having a plurality of cylinders therein, and a fuel injection system for supplying fuel to the cylinders, the fuel injection system comprising at least one fuel injector nozzle for each cylinder and a dedicated fuel pressure accumulator for each cylinder, wherein the engine includes a plurality of cylinder heads, for the cylinders respectively, and the fuel pressure accumulators for the respective cylinders are located at least partially within the cylinder heads respectively.

3. A piston engine according to claim 2, wherein a fuel injector nozzle is disposed within each cylinder head and a pressure accumulator extends into the cylinder head to the injector nozzle and projects from an exterior surface of the cylinder head.

4. A piston engine comprising:

an engine block having a plurality of cylinders therein, and a fuel injection system for supplying fuel to the cylinders, the fuel injection system comprising at least one fuel injector nozzle for each cylinder and a dedicated fuel pressure accumulator for each cylinder, wherein each fuel pressure accumulator comprises an accumulator body that defines at least two chambers that are in fluid communication with each other and are bounded by an at least partially common intermediate wall.

5. A piston engine according to claim 4, wherein the accumulator body defines a main chamber and at least one auxiliary chamber, and the main chamber and the auxiliary chamber are interconnected by at least two passages.

6. A piston engine according to claim 5, wherein the pressure accumulator is elongated and has first and second opposite ends and the main chamber and the auxiliary chamber are interconnected by first and second passages, at the first and second ends respectively of the pressure accumulator.

7. A piston engine according to claim 5, wherein the fuel injection system comprises a fuel supply tube system connected to the auxiliary chamber of the fuel pressure accumulator and the main chamber is connected to the fuel injector nozzle.

8. A piston engine comprising:

an engine block having a plurality of cylinders therein, and a fuel injection system for supplying fuel to the cylinders the fuel injection system comprising at least one fuel injector nozzle for each cylinder and a dedicated fuel pressure accumulator for each cylinder, wherein each pressure accumulator comprises an elongated body part that defines a main chamber and at least one auxiliary chamber each extending longitudinally of the body part, and each pressure accumulator further comprises a first end part and a second end part attached to the body part at opposite respective ends thereof and each defining at least one passage connected to at least one of said chambers.

9. A piston engine according to claim 8, wherein the body part is essentially round in cross section and has a central axis, and the chambers are essentially round in cross section and are parallel to the central axis of the body part.

10. A piston engine according to claim 9, wherein the chambers are arranged substantially symmetrically with respect to the central axis of the body part.

11. A piston engine according to claim 8, comprising a dedicated fuel pressure accumulator for each fuel injector nozzle.

12. A piston engine according to claim 1, wherein the fuel injection system comprises a fuel supply tube system connected to the fuel injector nozzles through the fuel pressure accumulators respectively.

13. A piston engine according to claim 1, wherein each fuel pressure accumulator comprises an accumulator body that defines at least two chambers that are in fluid communication with each other and are bounded by an at least partially common intermediate wall.

14. A piston engine according to claim 1, wherein each pressure accumulator comprises an elongated body part that defines a main chamber and at least one auxiliary chamber each extending longitudinally of the body part, and each pressure accumulator further comprises a first end part and second end part attached to the body part at opposite respective ends thereof and each defining at least one passage connected to at least one of said chambers.

15. A piston engine according to claim 1, comprising a dedicated fuel pressure accumulator for each fuel injector nozzle.

16. A piston engine according to claim 2, wherein the fuel injection system comprises a fuel supply tube system connected to the fuel injector nozzles through the fuel pressure accumulators respectively.

17. A piston engine according to claim 2, wherein each fuel pressure accumulator comprises an accumulator body that defines at least two chambers that are in fluid communication with each other and are bounded by an at least partially common intermediate wall.

18. A piston engine according to claim 2, wherein each pressure accumulator comprises an elongated body part that defines a main chamber and at least one auxiliary chamber each extending longitudinally of the body part, and each pressure accumulator further comprises a first end part and a second end part attached to the body part at opposite respective ends thereof and each defining at least one passage connected to at least one of said chambers.

19. A piston engine according to claim 2, comprising a dedicated fuel pressure accumulator for each fuel injector nozzle.

20. A piston engine according to claim 4, comprising a dedicated fuel pressure accumulator for each fuel injector nozzle.

21. A piston engine according to claim 4, wherein the fuel injection system comprises a fuel supply tube system connected to the fuel injector nozzles through the fuel pressure accumulators respectively.

22. A piston engine according to claim 8, comprising a dedicated fuel pressure accumulator for each fuel injector nozzle.

23. A piston engine according to claim 8, wherein the fuel injection system comprises a fuel supply tube system connected to the fuel injector nozzles through the fuel pressure accumulators respectively.

* * * * *